US011319199B2

(12) United States Patent
Liu

(10) Patent No.: US 11,319,199 B2
(45) Date of Patent: May 3, 2022

(54) ROTATING STRUCTURE FOR A BEARING SECTION OF A WORKSTATION

(71) Applicant: Chao Shuan Liu, Taipei (TW)

(72) Inventor: Chao Shuan Liu, Taipei (TW)

( * ) Notice: Subject to any disclaimer, the term of this patent is extended or adjusted under 35 U.S.C. 154(b) by 127 days.

(21) Appl. No.: 16/921,888

(22) Filed: Jul. 6, 2020

(65) Prior Publication Data

US 2022/0002124 A1 Jan. 6, 2022

(51) Int. Cl.
*B66F 7/28* (2006.01)
*B66F 7/06* (2006.01)

(52) U.S. Cl.
CPC ..... *B66F 7/28* (2013.01); *B66F 7/065* (2013.01)

(58) Field of Classification Search
CPC ... A47B 3/083; A47B 3/12; A47B 2003/0835; A47B 13/081; B66F 7/28; B66F 5/00; B66F 5/02; B66F 7/00; B66F 7/0625; B66F 7/065; B66F 2700/00; B25H 1/0007; B25H 1/0014; B25H 1/14
USPC ..... 254/133 R, 134; 108/86, 87; 187/221
See application file for complete search history.

(56) References Cited

U.S. PATENT DOCUMENTS 5,236,065 A * 8/1993 Isogai ..... B66F 7/04 187/219
5,690,314 A * 11/1997 Williams ..... B66F 7/243 254/88
5,855,359 A * 1/1999 Chipperfield ..... B66F 7/065 254/88
6,345,693 B1 * 2/2002 Yeo ..... B25H 1/0014 187/211
8,256,357 B2 * 9/2012 Kelly ..... F16N 31/006 108/55.5
8,667,903 B1 * 3/2014 Goltry ..... A47B 1/05 108/4
9,138,889 B2 9/2015 Liu
9,499,378 B2 * 11/2016 Kelly ..... B62B 3/00
10,005,649 B2 6/2018 Liu
10,295,311 B1 * 5/2019 Trubacek ..... A47B 13/081
2009/0289432 A1 * 11/2009 Liu ..... B66F 7/08 280/79.11
2010/0012909 A1 * 1/2010 Lee ..... B66F 7/085 254/93 R (Continued)

FOREIGN PATENT DOCUMENTS

CA 2993863 A1 * 8/2018 ..... B60P 1/02

OTHER PUBLICATIONS

CA-2993863-A1 Espacenet translation (Year: 2021).*

*Primary Examiner* — Joseph J Hail
*Assistant Examiner* — Timothy Brady

(57) ABSTRACT

A rotating structure for bearing section of workstation suitable for repairing or maintaining auto mobiles with large sized tires, has a main board, a supporting module, at least two corresponding loading boards and a plurality of long and shorter horizontal rods. The loading board has multiple sections, and the loading board further has a plurality of engaging apertures at a corresponding side facing the main board. Each longer horizontal rod and one shorter horizontal rod are paired together, the longer horizontal rod allows to the loading board to rotate and the shorter horizontal rod is secured between the loading board and the main board. By removing one of the shorter horizontal rod one end of the loading board is released for rotation.

3 Claims, 7 Drawing Sheets

(56) References Cited

U.S. PATENT DOCUMENTS

| | | | | |
|---|---|---|---|---|
| 2013/0119594 | A1* | 5/2013 | Liu | B25H 1/0007 269/15 |
| 2017/0174487 | A1* | 6/2017 | Cudney | B66F 7/08 |
| 2019/0168375 | A1* | 6/2019 | Castro | B25H 1/02 |
| 2019/0269239 | A1* | 9/2019 | Lindblad | A47B 9/12 |
| 2020/0221867 | A1* | 7/2020 | Hoffman | A47B 13/081 |

* cited by examiner

ROTATING STRUCTURE FOR A BEARING SECTION OF A WORKSTATION

BACKGROUND OF THE INVENTION

1. Field of the Invention

The present invention relates to a maintenance station, and more particularly to a rotating structure for a bearing section of a workstation for automobiles with large tires.

2. Description of Prior Art

As shown in FIG. 1, in U.S. Pat. No. 9,138,889, a conventional workstation table 2 has two loading boards 22, 22' combined with a main board 20 and is only suitable for four wheeled vehicles maintenance. For three-wheeled type of vehicles, the loading board 22,22' will keep the maintenance personnel away from vehicles which causes difficulties and inconveniences for maintenance.

Recently, the development of vehicle models are increasingly diverse, there are four-wheel vehicles, tricycles including one single front wheel with two rear wheels type or two front wheels with one single rear wheel type. Please refer to FIG. 2, in U.S. patent Ser. No. 10/005,649, a workstation 2 is composed of a main board 20 and a supporting module 21. the loading boards 22, 22' mounted at the two sides of the workstation respectively can be break into two sections, which can be suitable for the two front wheels-one single rear wheel type and the one single front wheel-two rear wheels type. With the easy assembly of the front loading board or the rear loading board, the technicians can work on different type of vehicles easily.

However, the above-mentioned structures are not suitable for vehicles with large sized tires, such as UTV (Utility Vehicle) or ATV (All Terrain Vehicle). Those vehicles might have tire widths from 6" to 12". In the above structures, as shown in FIGS. 1 and 2, the tire width A1 is only about 6~8 inches and the loading board 22, 22' width A is 12".

Therefore, it is desirable to provide a rotating structure for bearing section of workstation for automobiles with large tires to mitigate and/or obviate the aforementioned problems.

SUMMARY OF THE INVENTION

In order to achieve the above-mentioned objective, A rotating structure for bearing section of workstation suitable for repairing or maintaining auto mobiles with large sized tires, has a main board, a supporting module, at least two corresponding loading boards and a plurality of long and shorter horizontal rods. The loading board has multiple sections, and the loading board further has a plurality of engaging apertures at a corresponding side facing the main board. Each longer horizontal rod and one shorter horizontal rod are paired together, the longer horizontal rod allows to the loading board to rotate and the shorter horizontal rod is secured between the loading board and the main board. By removing one of the shorter horizontal rod one end of the loading board is released for rotation.

Other objects, advantages, and novel features of invention will become more apparent from the following detailed description when taken in conjunction with the accompanying drawings.

DETAILED DESCRIPTION OF THE INVENTION

Figure 1:
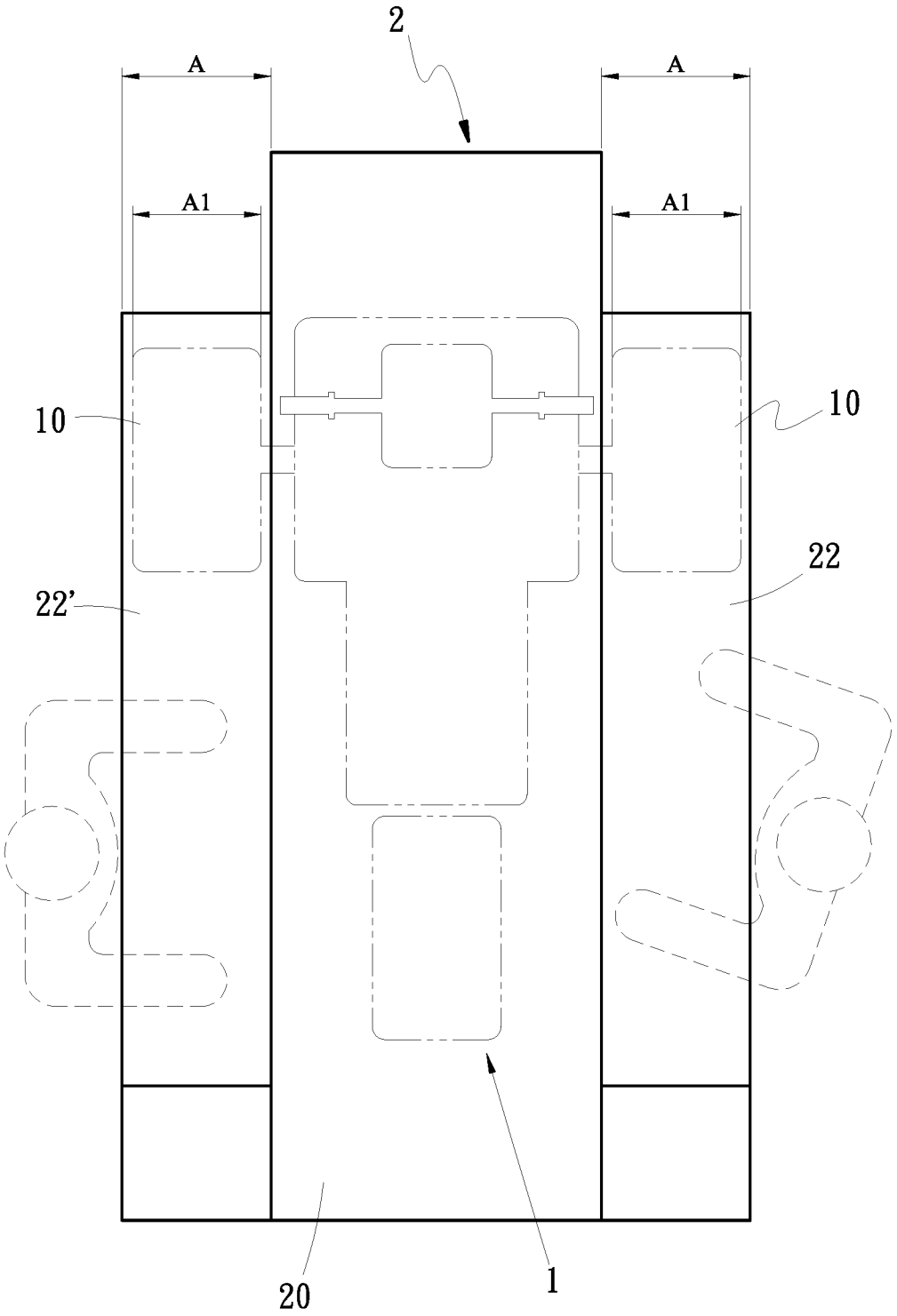
Fig. 1 PRIOR ART
FIG. 1 is a schematic drawing of a conventional repairing station.
Figure 2:
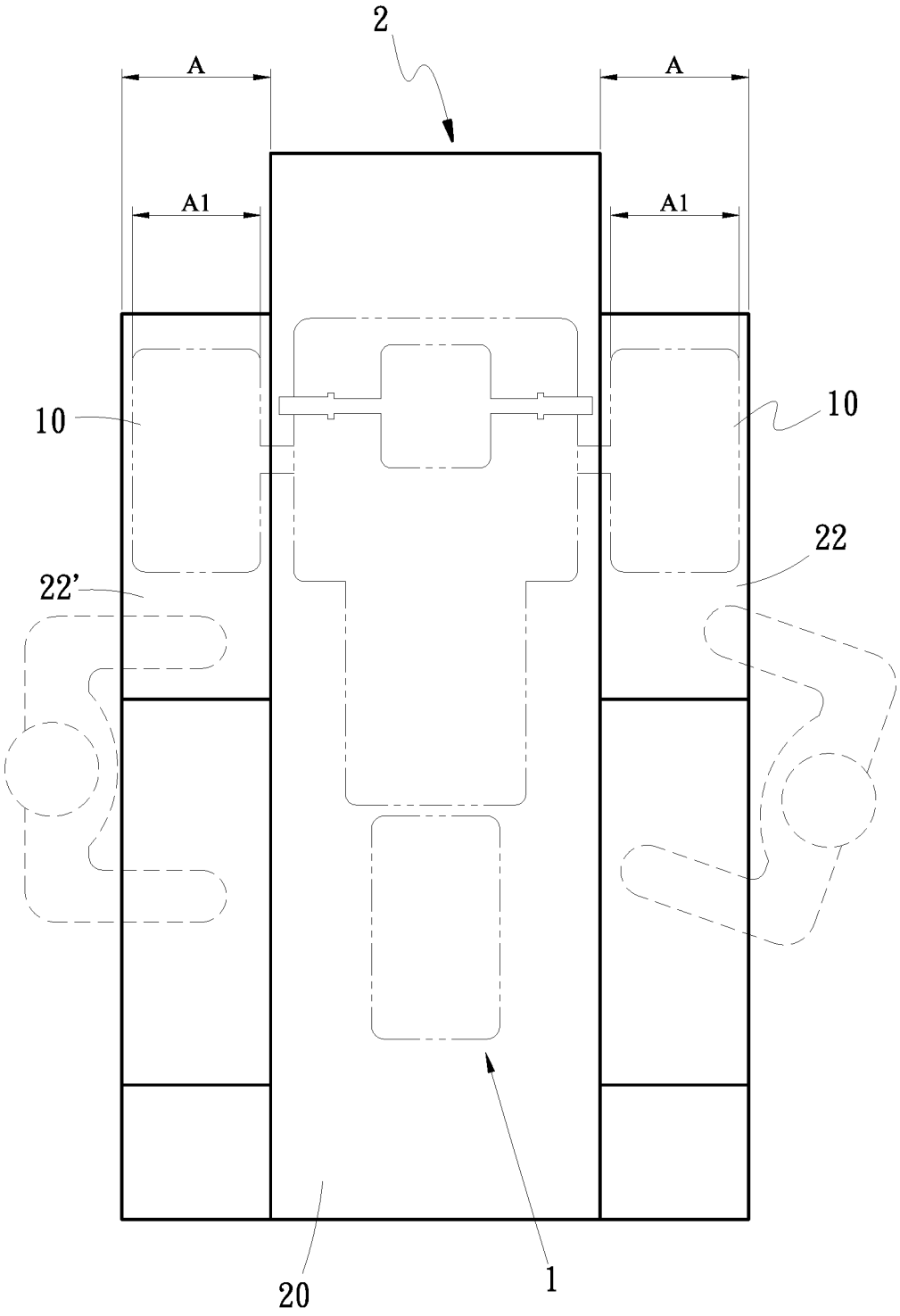
Fig. 2 PRIOR ART
FIG. 2 is a perspective view of a workstation according to an embodiment of the present invention.
Figure 3:
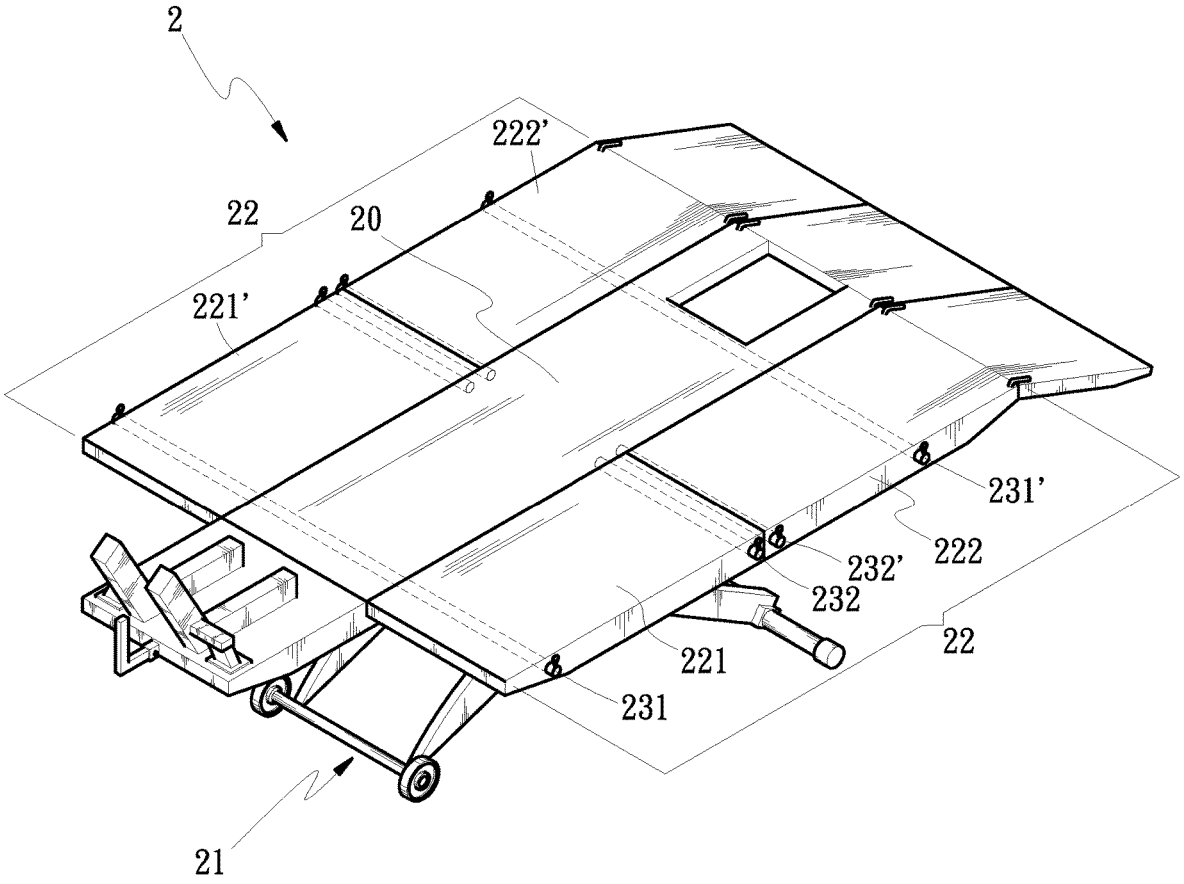
FIG. 3 is an exploded view of the workstation according to the embodiment of the present invention.
Figure 4:
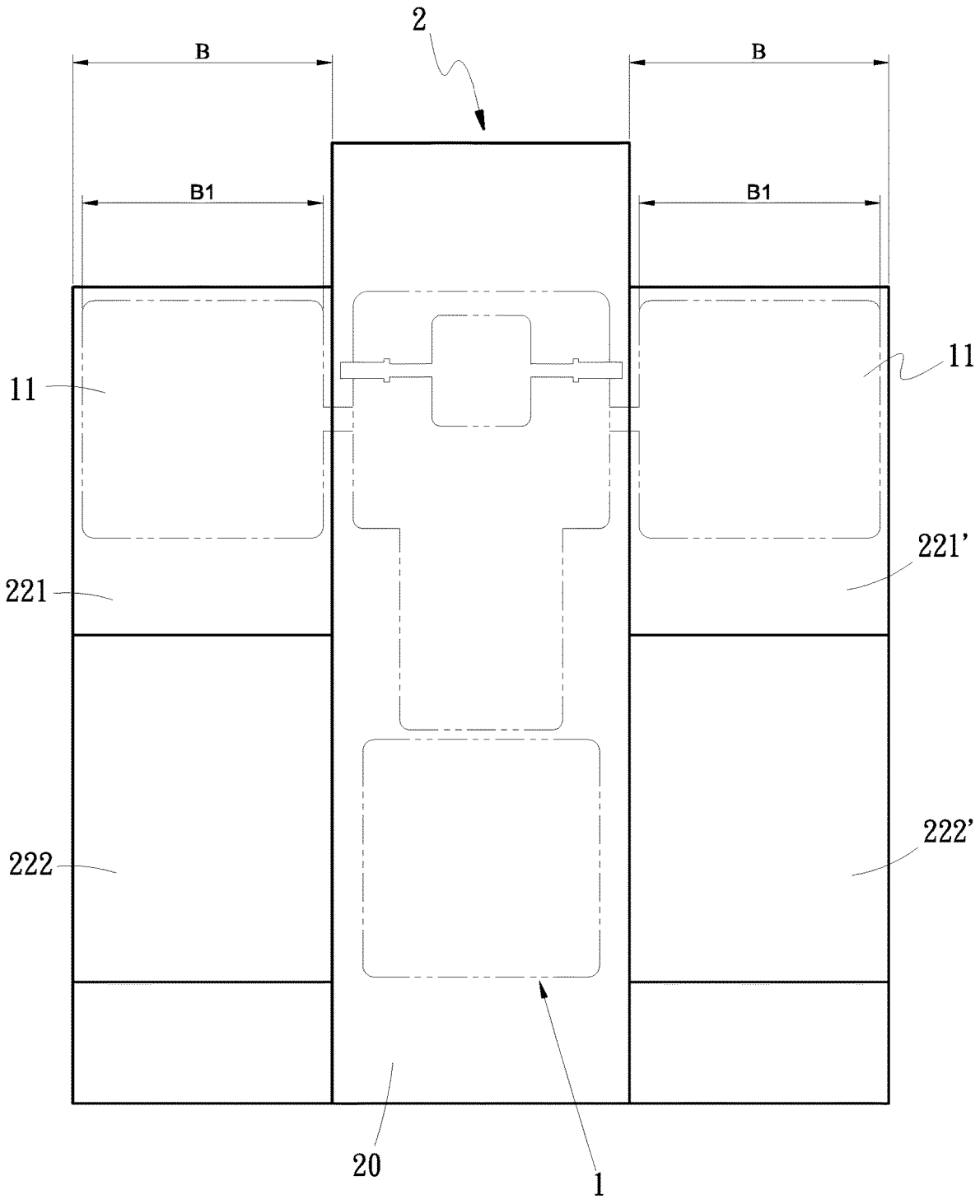
FIG. 4 is a schematic drawing of a loading board according to the embodiment of the present invention.
Figure 5:
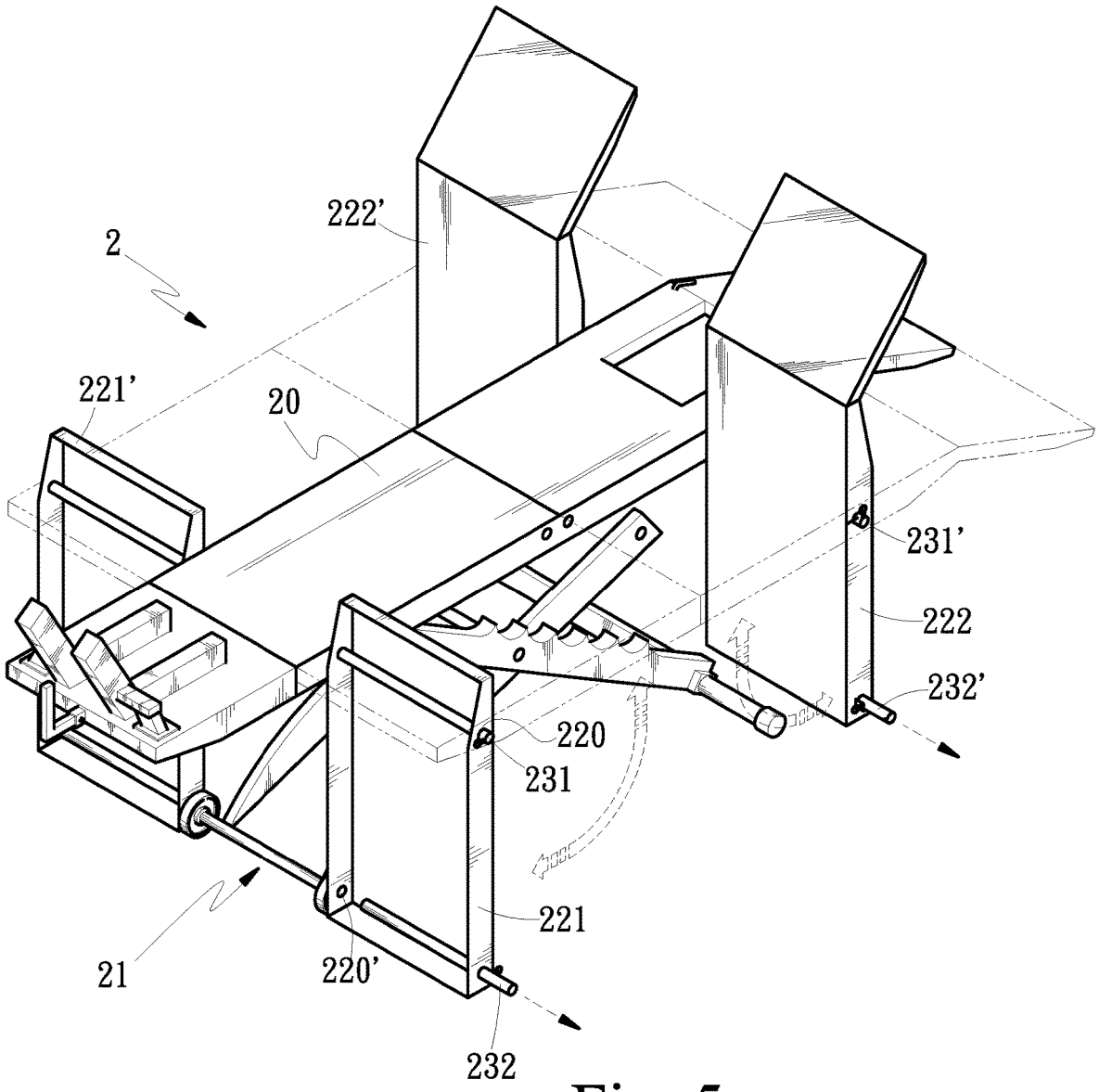
FIG. 5 is a movement schematic drawing of the loading board according to the embodiment of the present invention.

Please refer to FIGS. 3, 4 and 5. The workstation 2 is composed of a main board 20 and a supporting module 21. The supporting module 21 supports the workstation 2 and provides adjustable height for the workstation 2. The main board 20 further has at least two corresponding loading boards 221, 221', 222, 222' and a plurality of horizontal rods 231, 232, 231', 232' placed through the loading boards 221, 221', 222, 222'.

Furthermore, the loading board 22, 22' further includes a front loading board 221, 221' and a rear loading board 222, 222', and each loading board also has a plurality of engaging apertures 220, 220' on a corresponding side facing the main board 20. Each engaging aperture 220 is located corresponding to the longer horizontal rod 231 and configured as a rotate shaft, and each engaging aperture 220' is located corresponding to the shorter horizontal rod 232 and allows the front and rear loading boards 221, 221', 222, 222' to be engaged with the main board 20.

In this embodiment, a cross-sectional width B1 of the tire 11 is between 10~12 inches, and the width B of the loading boards 221, 221', 222, 222' can be up to 24".

Please also refer to FIG. 5, each of the loading boards 221, 221', 222, 222' on both sides of the main board 20 is respectively rotatable around the longer horizontal rod 231 and secured by one shorter horizontal rod 232. Therefore, the loading board can be rotated and adjusted on both sides of the main board 20 to cater the width of the workstation 2 for the vehicle with a wider cross-section width tire 11, and the technician can be closer to the maintenance vehicle for operations.

Figure 6:
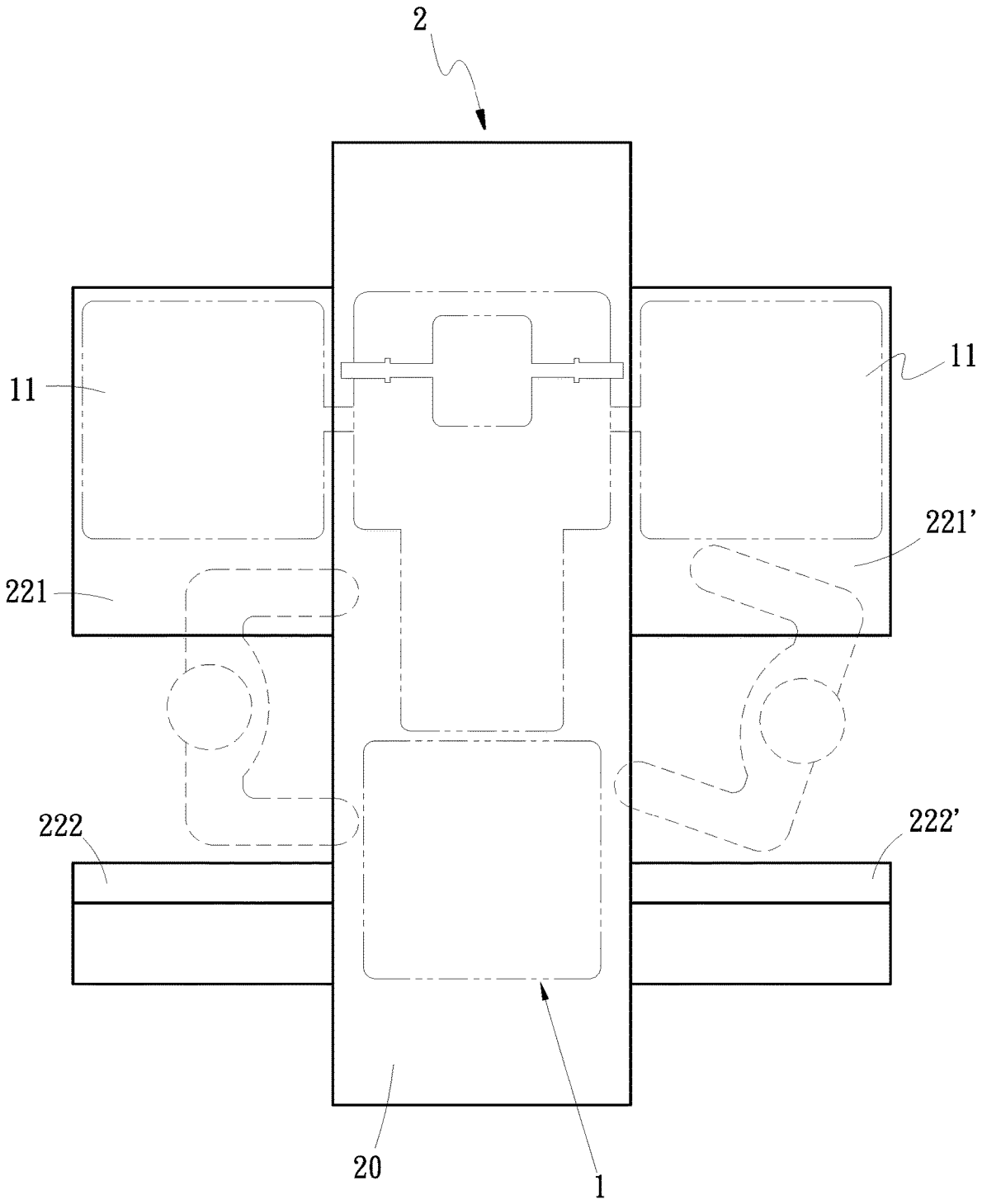
FIG. 6 shows when technicians working with the loading board according to the embodiment of the present invention.

Please refer to FIG. 6 again. When the maintenance vehicle is a vehicle with two front wheels and one rear wheel, the technician can pull out the shorter horizontal rod 232' of the loading boards 222, 222', and then rotate the loading board 222, 222' around the longer horizontal rod 231', which makes the loading board 222, 222' vertical and allowing the technician to get closer to the maintenance vehicle for operations.

Figure 7:
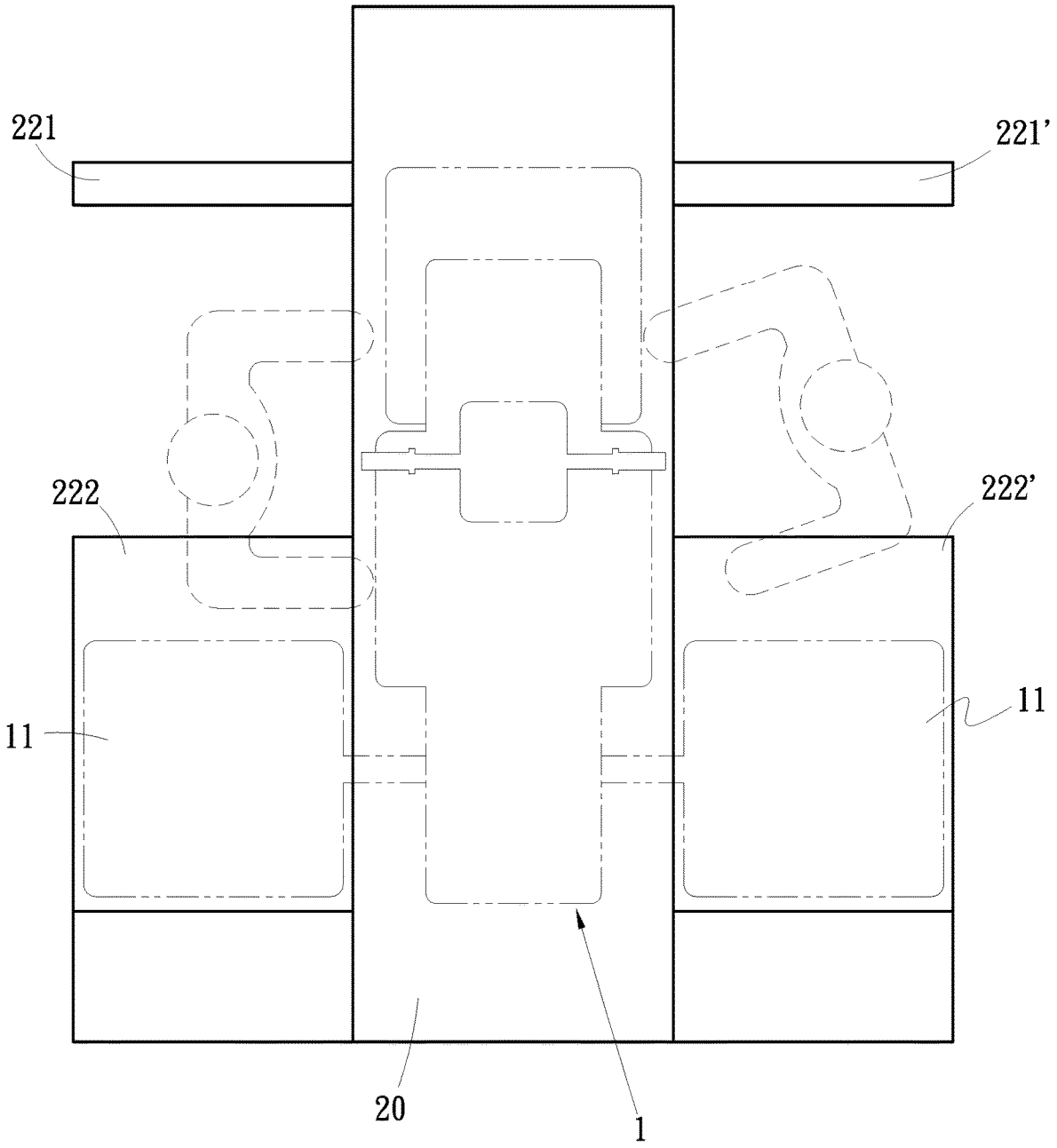
FIG. 7 again shows when technicians working with the loading board according to the embodiment of the present invention.

Alternatively, as shown in FIG. 7, when the maintenance vehicle is the front single-wheel and two rear-wheel models, the technician can pull out the shorter horizontal rod 232 of the loading boards 221, 221', and then the loading board 221, 221' rotates around the longer horizontal rod 231, which makes the loading board 222, 222' vertical and allowing maintenance personnel to get closer to the maintenance vehicle for operations.

The best embodiment of this invention is designed for the vehicle models with large tire width (about 10"~12"), and the increased width B of the loading board satisfies the requirement. Moreover, since the width of the loading board is wider, the weight of the loading board is also doubled, which is difficult to remove the loading board by disassembly. Therefore, utilizing the longer horizontal rod 231 as a rotating shaft to allow the large loading board 221, 221', 222, 222' can be rotated vertically on the workstation 2, which give the technician better access and approach to the maintenance vehicle.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A rotating structure for a bearing section of a workstation suitable for repairing or maintaining auto mobiles with large sized tires, comprising: a main board, a supporting module, at least two corresponding loading boards and a plurality of longer and shorter horizontal rods; characterized in that:

the loading board has multiple sections, and the loading board further has a plurality of engaging apertures at a corresponding side facing the main board;

each longer horizontal rod and one shorter horizontal rod are paired together, the longer horizontal rod allowing the loading board to rotate and the shorter horizontal rod secured between the loading board and the main board;

wherein by removing one of the shorter horizontal rods one end of the loading board is released for rotation.

2. A rotating structure for a bearing section of a workstation as claimed in claim 1, wherein each longer horizontal rod passes through both corresponding loading boards at both sides of the main board.

3. A rotating structure for a bearing section of a workstation as claimed in claim 1, wherein each shorter horizontal rod passes through one side the loading board and the main board.

* * * * *